United States Patent [19]

McKenzie

[11] Patent Number: 4,568,138

[45] Date of Patent: Feb. 4, 1986

[54] ELECTRICAL WIRE CONNECTOR

[76] Inventor: Thomas J. McKenzie, 6230 N. Camino Pimeria Alta, Tucson, Ariz. 85718

[21] Appl. No.: 669,388

[22] Filed: Nov. 8, 1984

[51] Int. Cl.[4] ..... H01R 11/09

[52] U.S. Cl. ..... 339/204; 339/61 M

[58] Field of Search ..... 339/19, 198 R, 198 S, 339/198 P, 203, 204, 242, 248 R, 248 S, 259 R, 61 M; 174/87

[56] References Cited

U.S. PATENT DOCUMENTS

| | | | |
|---|---|---|---|
| 1,719,288 | 7/1929 | Danielson | 339/95 R |
| 2,077,587 | 4/1937 | Rowe | 339/259 F |
| 3,175,179 | 3/1965 | Trump | 339/18 C |
| 3,437,981 | 4/1969 | Keller | 339/103 |
| 3,733,574 | 5/1973 | Scoville et al. | 339/198 S |
| 3,739,470 | 6/1973 | Eppler | 29/628 |
| 3,835,241 | 9/1974 | Masterson | 174/87 |
| 3,851,294 | 11/1974 | Palazzetti et al. | 339/61 M |
| 3,868,475 | 2/1975 | Allison | 174/87 |
| 3,868,577 | 11/1974 | Kuo | 174/84 |
| 3,879,575 | 4/1975 | Dobbin | 174/92 |
| 4,143,237 | 3/1979 | Atkins | 174/87 |
| 4,296,987 | 10/1981 | Lingaraju | 339/95 |

FOREIGN PATENT DOCUMENTS

| | | | |
|---|---|---|---|
| 1245234 | 9/1971 | United Kingdom | 339/19 |
| 1514988 | 6/1978 | United Kingdom | 339/19 |

OTHER PUBLICATIONS

Oriental Terminal Products Co. Ltd., 3 pages, 1-1980.

*Primary Examiner*—Neil Abrams
*Attorney, Agent, or Firm*—H. Walter Clum

[57] ABSTRACT

A connector for electrical wires of the same or different gauges comprising a flat narrow rectangular casing housing two or more electrically interconnected receptacle units arranged in line for receiving and cooperating with resilient means within the casing for tightly engaging wire ends inserted within the receptacle.

10 Claims, 10 Drawing Figures

Fig. 1.
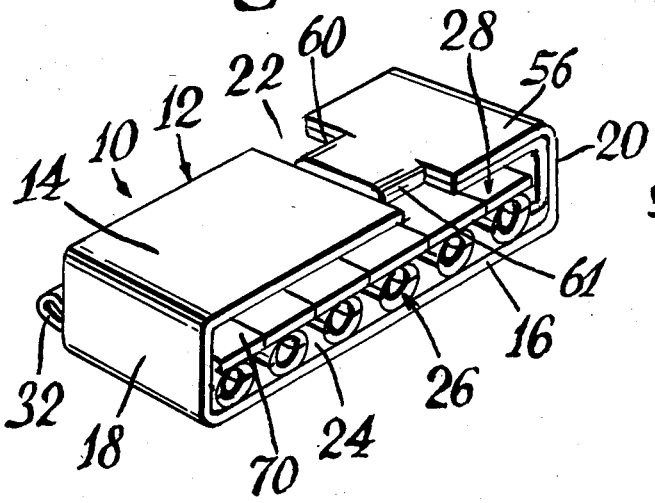
Fig. 2.
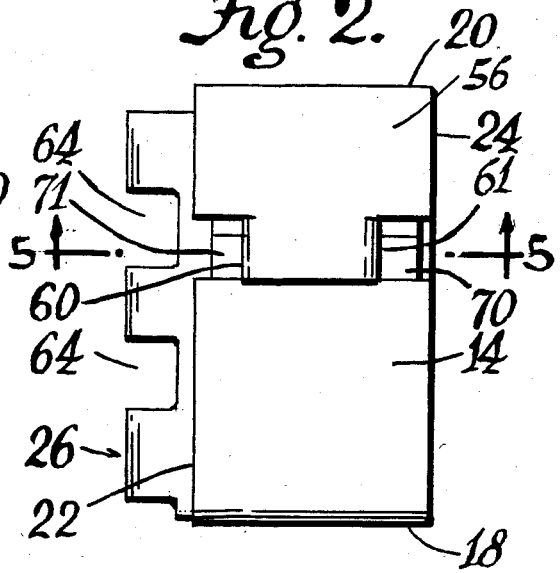
Fig. 4.
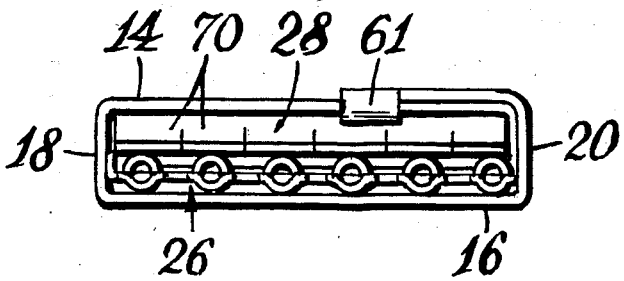
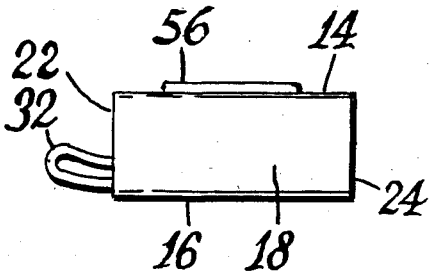
Fig. 3.
Fig. 5.
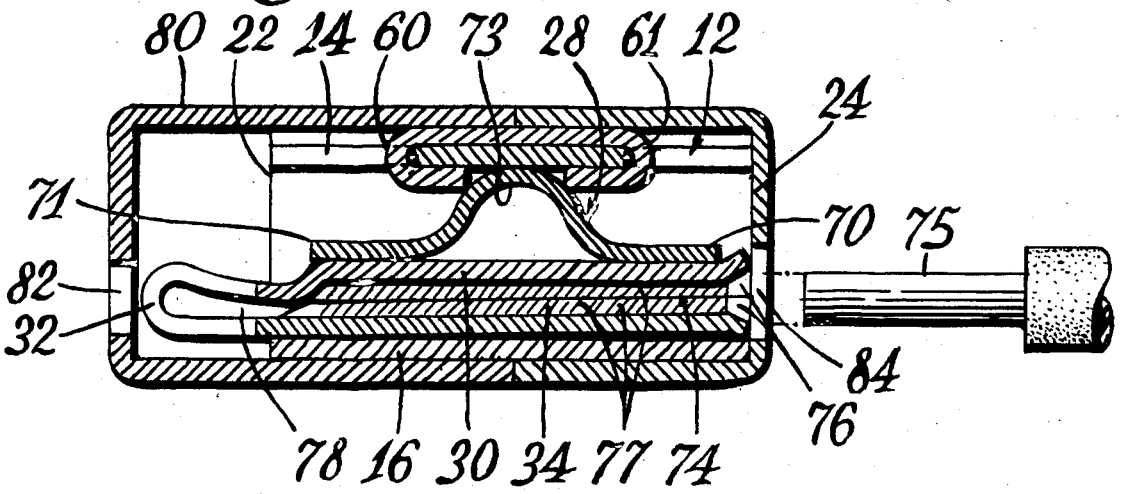

ELECTRICAL WIRE CONNECTOR

BACKGROUND OF THE INVENTION

The present invention relates to electrical wire connectors, and while not limited thereto, finds its particular usefulness in the wiring of commercial buildings and houses wherein the interconnection of wires customarily is accomplished in small "boxes" of limited capacity in which rather bulky wire connectors, such as "wire nuts" are used for connecting twisted wire ends, in addition to receiving the usual wall plugs accomodated therein. The present invention was conceived to overcome the limitations of the prior art connectors.

DESCRIPTION OF THE PRIOR ART

Wire connectors now in common use in building construction for the interconnection of wires are the so-called "wire nuts" mentioned above for receiving twisted ends of wires to be interconnected. Of course there have been a number of devices patented in an effort to overcome the limitations of the prior art connectors now in common use but none have succeeded in acceptance by practitioners in the building trades.

SUMMARY OF THE INVENTION

It is the primary object of this invention to provide an electrical wire connector of improved design which overcomes the limitations of the connectors now in common use in the buildings trades.

Another object is to provide such a connector providing means for the easy interconnection and disconnection of electrical wires while still maintaining them tightly engaged against accidental disconnection.

A further object is to provide a connector which makes it possible for the interconnection of more wires in less space than is now possible in wire connectors now in common use.

Still further it is an object of the invention to provide an improved connector which easily receives slightly damaged wire ends and at the same time holds them against accidental disconnection.

The invention also has as an object to provide a wire connector which facilitates the detection of troubled electrical circuits interconnected within the connector.

BRIEF DESCRIPTION OF THE DRAWINGS

The foregoing and other objects and advantages of the invention will become apparent from the detailed description of the accompanying drawings, in which:

FIG. 1 is a perspective view of the preferred embodiment of the invention with its dialectric covering removed;

FIG. 2 is a top plan view of the invention as shown in FIG. 1;

FIG. 3 is an end elevational view of the connector as seen in FIG. 2;

FIG. 4 is a front elevational view;

FIG. 5 is a greatly enlarged sectional view taken along the line 5—5 on FIG. 2;

DESCRIPTION OF THE PREFERRED EMBODIMENT

Figure 6:
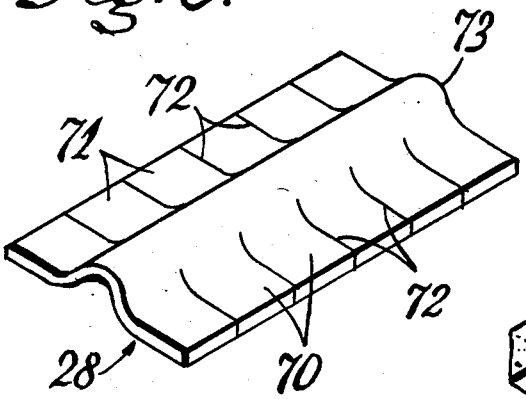
FIG. 6 is a perspective view of a resilient means employed in the invention in the form of a spring leaf.

First with referrence to FIG. 1, it is seen that the novel wire connector of the present invention generally indicated by the numeral 10, comprises a narrow rectangular metallic casing 12 formed by a pair of closely spaced rectangular walls 14 and 16 interconnected on opposite sides by end walls 18 and 20 leaving the other sides 22 and 24 open. A wire receiving electrically conductive receptacle 26 including six units is positioned within the casing and pressed against the inner surface of wall 16 by a resilient means in the form of a spring leaf 28.

Figure 8:
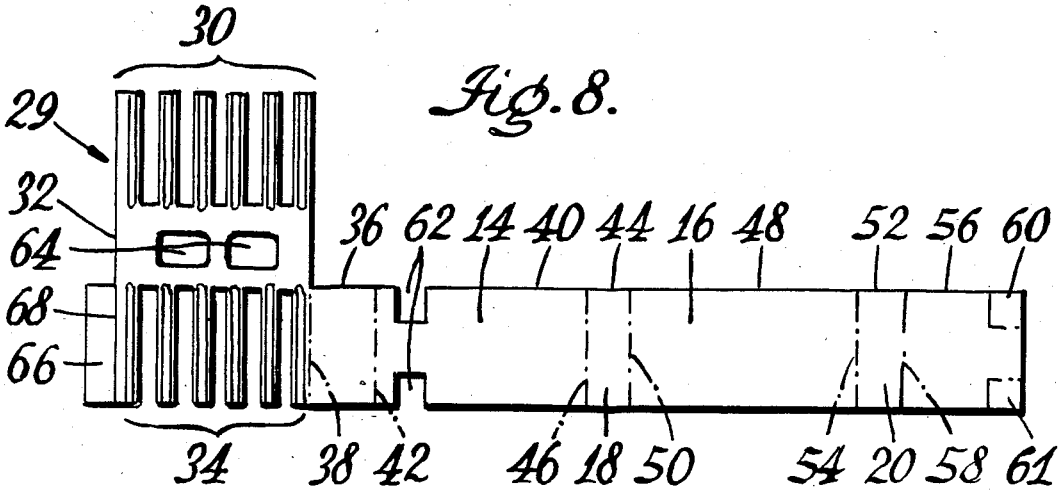
FIG. 8 is a plan view of a metal blank which is bent and formed into the wire connector embodying the invention.

While the casing and wire receiving receptacle may be formed separately, in this preferred form of the invention and as seen in FIG. 8, they are formed from a single blank 29 of electrically conductive metal, such as copper or brass. As shown in this figure the various parts are identified by the same numerals used in describing the complete connector in FIGS. 1 through 4. The wire receptacle 26 is formed by bending the six channel portions 30 upwardly around the intermediate connecting portion 32 and then downwardly over the channel portions 34. The casing 12 is formed by bending the portion 36 upwardly about line 38 then turning portion 40 about line 42 over the receptacles to form the rectangular wall 14. Next the portion 44 is bent downwardly about line 46 to form end wall 18. Then portion 48 is turned about line 50 under the receptacles to form wall 16. Portion 52 is then bent upwardly about line 54 to form end wall 20, and finally portion 56 is bent about line 58 over wall 14 with tabs 60 and 61 turned downwardly through cuts 62 in wall 14 and under the wall, as seen more clearly in FIG. 5, thus to lock the various portions together to form the casing and receptacle. The intermediate portion 32 is provided with a pair of apertures 64 for the purpose to be explained later. A little tab 66 is bent upwardly about line 68 to space the receptacle from end wall 18.

Returning now to FIGS. 1 through 5 it will be seen that in this preferred form of the invention receptacle 26 is provided with six in line wire receiving units. However, it should clearly be understood that this number is merely illustrative and that more or even less of these units may be provided to take care of different needs.

In FIG. 6 it is seen that spring leaf 28 is divided into opposing finger portions 70 and 71 by cuts 72, each finger being positioned over and against one of the receptacle units. The oppositely positioned fingers being separated by the hump 73 which extends above the receptacle units into contact with the under side of wall 14 (FIG. 5) thus cooperating with the spring fingers to press the channel members 30 and 34 tightly against each other and the receptacle units against the inner surface of wall 16. In this condition the wire receiving space 74 between the channels 30 and 34 is of a dimension something less than the gauge of the smallest wire for which the particular connector is designed to receive, as indicated by the numeral 75 on FIG. 5. The spring leaf 28 is retained within the casing 12 by the inturned tabs 60 and 61 which hug the opposite sides of the hump 73.

Figure 9:
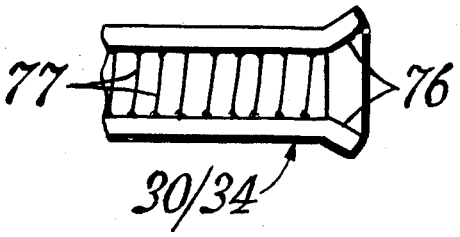
FIG. 9 is a greatly enlarged view of a fragmentary end portion of the wire receiving receptacle units of the invention showing the slightly flared end and the serrated inner surface thereof.

The outer ends of the channels 30 and 34 are slightly flared as shown on FIGS. 5 and 9 in order to guide the wire ends into the receptacle units. Also shown in FIG. 9 the inner surfaces of the channel members are serrated in an angular direction from side to side as indicated at the numeral 77. These serrations are somewhat similar to a file and have a similar function when wires with slightly damaged surfaces are inserted into the receptacle units. These serrations also provide a tighter grip upon the wires in addition to that provided by the spring leaf 28. Also they have a tendency to turn slightly bent wire ends into a position providing maximum surface contact between the channel members and wire.

When in use, such as illustrated in FIG. 5, wires may be inserted into the receptacle units by finger pressure spreading channels 30 and 34 against the pressure of spring leaf fingers 70 and 71 thereby exerting adequate pressure upon the wires to lock them in the receptacle units. The grip upon the wires will be increased by engagement of the serrations 77 there against.

While it is possible to remove the wires from the receptacle units by hand with enough "pull", removal may be eased by the insertion of suitable tool, such as a screwdriver, through apertures 64 at the rear of the receptacle and between the channel members, as at 78 in FIG. 5, thereby spreading the channel members against the rear spring fingers 71.

A suitable housing of dialectric material 80 encloses the connector and as seen in FIG. 5, is provided with one or more openings 82 at the rear of the housing to permit insertion of the tool to ease removal of wires therefrom, and openings 84 in its front surface aligned with the receptacle units to permit the insertion of wires into the receptacle units.

The invention makes it easy to detect troubled or defective electrical circuits interconnected therein. By way of example, with the receptacle units illustrated within the connector it is possible to isolate a defective or disconnected circuit. If a circuit becomes defective or disconnected at some other place, it may easily and quickly be detected simply by selectively withdrawing one of the wires successively in each of the circuits until the defective one is found. Undamaged circuits will be reconnected by the reinsertion of the withdrawn wires.

MODIFICATIONS

Figure 7:
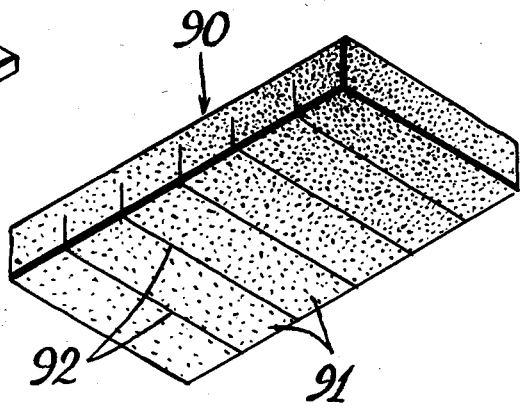
FIG. 7 is perspective view of another form of resilient means but in the form of a block of rubber or other similar resilient material.
Figure 10:
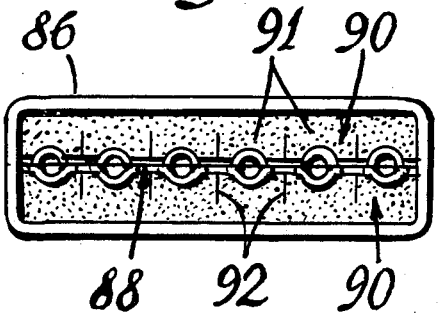
FIG. 10 is a front elevational view of a modified form of the present invention.

FIG. 10 illustrates one of the possible and important modifications falling within the scope of the invention. In this form there is a rectangular casing 86 which may be of metal or even some suitable dialectric material. A wire receiving receptacle 88 similar to that in the preferred form of the invention is positioned within the casing sandwiched between a pair of resilient members 90 of rubber or similarly resilient material. As seen in FIG. 7, one of the surfaces of these members is formed into elongate bars 91 by slits 92. These bars correspond to the fingers 70 and 71 in spring leaf 28 of the preferred form, and serve the same purpose, that is, of pressing together the channel members which form the receptacle units, and in condition to receive and hold wires to be inserted therein.

Of course, it will be understood that one of the resilient members 90 shown in FIG. 7 may substitute for the spring leaf 28 in the preferred form of the invention, and that two of the spring leafs 28 could replace the resilient members 90 in the modified form.

Having now described some of the various forms in which the invention may be embodied, it will be apparent to those skilled in the building art that it in fact does provide a novel electrical wire connector incorporating the attributes set forth in the stated and other objects of the invention.

What is claimed is:

1. An electrical wire connector comprising:

a narrow rectangular casing formed by a pair of closely spaced thin rectangular walls interconnected by side walls leaving at least one open side wall in the casing;

a wire receiving electrically conductive receptacle fixed within the casing and being formed by a plurality of opposing arcuately shaped elongate channel members arranged in line and interconnected with each other at adjacent ends thereof and with their other ends forming openings adjacent the said open side of said casing and together forming individual receptacle units to receive wire ends;

resilient means positioned within said casing between at least one of said rectangular walls and said receptacle units thus to press the opposing channel members together whereby wires inserted within the units will spread the channel members against the said resilient means thereby pressing the said channel members tightly against inserted wires and releasibly locking the wires within the receptacle units; and wherein said resilient means comprises a spring leaf having oppositely extending finger portions positioned over and in contact with the individual ones of said channel members and a central portion engaging the rectangular wall above said receptacle whereby individual channels may spread differently against said finger portions to accomodate different wire sizes.

2. An electrical wire connector comprising:

a narrow rectangular casing formed by a pair of closely spaced thin rectangular walls interconnected by side walls leaving at least one open side wall in the casing;

a wire receiving electrically conductive receptacle fixed within the casing and being formed by a plurality of opposing arcuately shaped elongate channel members arranged in line and interconnected with each other at adjacent ends thereof with their other ends forming openings adjacent the said open side of said casing and together forming individual receptacle units to receive wire ends;

said casing and said receptacle being formed as a unitary entity from a single metal member bent and formed to shape; and resilient means positioned within said casing between one of said rectangular walls and said receptacle thereby pressing said receptacle against the other of said rectangular walls and the opposing channel members together whereby wires inserted within the units will spread the channel members against the said resilient means thereby pressing the said channel members tightly against inserted wires and releasibly locking the wires within the receptacle units.

3. A wire connector according to claim 2 wherein said casing walls are of electrically conductive metal and said receptacle is secured to said casing at the side opposite to the open ends of said receptacle units, and further includes a dialectric housing enclosing said casing but leaving the open ends of said receptacle units exposed for insertion of said interconnection of wires when inserted therein.

4. An electrical wire connector according to claim 2 wherein said receptacle is provided with at least one aperature in the end opposite to the open end thereof whereby a suitable tool may be inserted between the channels to force them slightly apart to relieve the pressure of the resilient means on the channels to facilitate the removal of wires inserted therein.

5. An electric wire connector according to claim 2 wherein the arcuate inner surfaces of said receptacle units are serrated substantially throughout their lengths thus to provide a tight grip on wires inserted therein under all conditions of normal use.

6. A construction according to claim 5 wherein said serrations are angled from one side to the other side of each channel and are of sufficient number and shape to effect a filing function to remove any roughness which might be present on the wire ends inserted into the receptacles.

7. A connector according to claim 2 wherein said resilient means comprises an integral block of rubber like material having one surface in contact with the casing wall above said receptacle and with its opposite surface provided with elongate bar like portions formed by slits in said surface, each bar being in contact with and urged against individual ones of said channel members.

8. An electrical wire connector comprising:

A. a narrow rectangular electrically conductive metallic casing formed by a pair of closely spaced rectangular walls interconnected on two opposite sides by end walls, the other side walls being left open;

B. a wire receiving electrically conductive receptacle having a plurality of wire receiving units formed by opposing arcuately shaped elongate channel members, said units being interconnected with each other at one end by an integral wall which extends slightly from one of said open sides of said casing with their other ends open and positioned adjacent to the other open side of the said casing, the said open ends of said receptacle units being flared to facilitate reception of wire ends thereinto, the inner surfaces of said channel members having arcuately shaped serrations extending around their inner surfaces from side to side and substantially through their lengths;

C. a spring leaf positioned within said casing and having oppositely extending finger portions over and in contact with individual ones of said receptacle units and an intermediate portion extending into engagement with the under side of the rectangular wall above the receptacle, thereby pressing said channel members together edge to edge and against the inner side of the other of said rectangular walls whereby individual units may spread differently to accomodate and releasibly lock different guage wires within said receptacle units when inserted therein;

D. said wall interconnecting said channel members at one end being provided with at least one aperture for the insertion of a suitable tool in said receptacle between said channel members thus to slightly separate them to facilitate the removal of wires from said receptacle units; and E. a dialectric housing around said casing and having openings permitting access for said wires and said tool.

9. An electrical wire connector according to claim 8 wherein said casing and said receptacle are formed from a single blank of metal bent and formed to suit.

10. An electrical wire connector comprising:

a narrow rectangular casing formed by a pair of closely spaced thin rectangular walls interconnected by side walls leaving at least one open side wall in the casing;

a wire receiving electrically conductive receptacle fixed within the casing and being formed by a plurality of opposing arcuately shaped elongate channel members arranged in line and interconnected with each other at adjacent ends thereof and with their other ends forming openings adjacent the said open side of said casing and together forming individual receptacle units to receive wire ends;

resilient means positioned within said casing between at least one of said rectangular walls and said receptacle units thus to press the opposing channel members together whereby wires inserted within the units will spread the channel members against the said resilient means thereby pressing the said channel members tightly against inserted wires and releasibly locking the wires within the receptacle units; and wherein said resilient means comprises a block of rubber like material provided with elongate bar like portions formed by slits in one of its surfaces and wherein each of said bar like portions is positioned along and in contact with one of said channel members thus to urge said channel members tightly against each other.

* * * * *